US006191069B1

(12) United States Patent
Tamura

(10) Patent No.: US 6,191,069 B1
(45) Date of Patent: Feb. 20, 2001

(54) THERMAL TRANSFER IMAGE RECEIVING SHEET

(75) Inventor: Yoshihiko Tamura, Tokyo (JP)

(73) Assignee: Dai Nippon Printing Co., Ltd. (JP)

( * ) Notice: Under 35 U.S.C. 154(b), the term of this patent shall be extended for 0 days.

(21) Appl. No.: 09/203,518

(22) Filed: Dec. 1, 1998

(30) Foreign Application Priority Data

Dec. 3, 1997 (JP) ..... 9-347309

(51) Int. Cl.[7] ..... B41M 5/035; B41M 5/38

(52) U.S. Cl. ..... 503/227; 428/304.4; 428/331; 428/913; 428/914

(58) Field of Search ..... 8/471; 428/195, 428/331, 913, 914, 488.4, 304.4; 503/227

(56) References Cited

U.S. PATENT DOCUMENTS 5,922,642 * 7/1999 Tamura ..... 503/227

FOREIGN PATENT DOCUMENTS 0 709 230 A1 5/1996 (EP) .
0 781 665 A2 7/1997 (EP) .

* cited by examiner

*Primary Examiner*—Bruce Hess
(74) *Attorney, Agent, or Firm*—Parkhurst & Wendel, L.L.P.

(57) ABSTRACT

A thermal transfer image receiving sheet comprising a substrate sheet and a dye receptive layer formed on at least one side of said substrate sheet, wherein a hydrophilic porous layer comprising a thermoplastic resin and hydrophilic porous particles, and an electric conductive releasing layer comprising cationic acrylic resin and cellulose acetate, are formed in this order on the opposite side of the surface on which is formed said dye receptive layer of said substrate sheet.

4 Claims, No Drawings

THERMAL TRANSFER IMAGE RECEIVING SHEET

TECHNICAL FIELD OF THE INVENTION

The present invention relates to a sublimation-type thermal transfer image receiving sheet, and more particularly, to a thermal transfer image receiving sheet comprising the formation of a back layer, which can be written on with various types of pens and pencils, on the side opposite the surface on which is formed a dye receptive layer, said thermal transfer image receiving sheet being resistant to becoming electrically charged even in environments of low humidity, and can be separated even when printing is performed while mistaking the dye receptive layer side and back side.

Although various types of thermal transfer methods are known in the art, among these, a method has been proposed wherein a sublimable dye is used as a recording material, which is supported on a substrate sheet made of polyester and so forth to form a thermal transfer sheet, and various types of full-color images are formed on an image receiving sheet on which is formed a specific receptive layer made of a transfer material such as paper or plastic film that can be dyed with the sublimable dye. In this case, a thermal head of a printer is used as heating means. A large number of colored dots of 3 or 4 colors are transferred to an image receiving sheet by heating for an extremely short period of time, and full color-images of a manuscript are reproduced by said multi-colored dots. Images formed in this manner are extremely clear since the coloring materials used are dyes. Since these materials also have excellent transparency, the resulting images have excellent reproducibility and contrast of intermediate colors, and are similar to the images produced by conventional offset printing or gravure printing. Moreover, high-quality images can be formed that are comparable to full-color photographic images.

With respect to this type of thermal transfer image receiving sheet, the providing of a thermal transfer image receiving sheet that allows writing with a writing instrument such as a lead pencil or water-based pen by providing a back layer composed of polyvinylbutyral resin and microsilica is disclosed in the prior art, examples of which include Japanese Patent Application Laid-Open No. HEI 9-175048 and Japanese Patent Application Laid-Open No. HEI 9-175052. In addition, the providing of a thermal transfer image receiving sheet that can be separated even if printing is mistakenly performed on the back side by further providing a layer composed of polyvinyl alcohol and so forth is disclosed in Japanese Patent Application Laid-Open No. HEI 9-193561.

However, in the case of a thermal transfer image receiving sheet like that described above, since it is susceptible to becoming electrically charged in environments of low humidity, when printing with a printer and during feeding or discharging of paper, there is the disadvantage of problems occurring such as multiple sheets being fed through the printer at one time and paper jamming in the printer.

Thus, an object of the present invention is to provide a thermal transfer image receiving sheet having a constitution by forming a back layer that can be written on with various types of writing means on the side opposite the side on which is formed a dye receptive layer, said thermal transfer image receiving sheet being resistant to becoming electrically charged even in environments of low humidity, and being able to be separated without the back side adhering to the dye film even when printing is performed while mistaking the dye receptive layer side and back side.

DISCLOSURE OF INVENTION

In order to achieve the above object, the present invention according to a first embodiment is characterized by providing a thermal transfer image receiving sheet comprising a substrate sheet and a dye receptive layer on at least one side of said substrate sheet, wherein a hydrophilic porous layer having for its main components thermoplastic resin and hydrophilic porous particles is formed on the side where a dye receptive layer is not formed, and an electric conductive layer having for its main components cationic acrylic resin and cellulose acetate is formed on top of the above layer in this order.

In addition, the present invention according to a second embodiment is characterized by providing a thermal transfer image receiving sheet comprising a substrate sheet and a dye receptive layer on at least one side of a substrate sheet, wherein a hydrophilic porous layer having for its main components thermoplastic resin and hydrophilic porous particles is formed on the side where a dye receptive layer is not formed, and an electric conductive layer having for its main component cationic acrylic resin and a releasing layer having for its main component cellulose acetate are sequentially formed on the above layer in this order.

In addition, it is preferable that the thermoplastic resin of the above hydrophilic porous layer be either butyral or acetal resin.

In addition, it is preferable that the hydrophilic porous particles of the above hydrophilic porous layer are untreated microsilica have a pore volume of 0.2 to 3.0 ml/g and a mean particle diameter of 0.2 to 5.0 $\mu$m.

The heat transfer image receiving sheet of the present invention is that comprising a substrate sheet and a dye receptive layer on at least one side of the substrate sheet, wherein a hydrophilic porous layer having for its main components thermoplastic resin and hydrophilic porous particles is formed on the side opposite the side on which the dye receptive layer is formed, and an electric conductive releasing layer having for its main components cationic acrylic resin and cellulose acetate is formed on the above layer. Consequently, the hydrophilic porous layer in particular gives writing properties to the back layer. Moreover, since the cationic acrylic resin and cellulose acetate of the electric conductive releasing layer are essentially incompatible resins, this property of being mutually incompatible gives electrical conductivity and water absorption due to the cationic acrylic resin, and gives separating and water-resistant performance due to the cellulose acetate. Consequently, the back layer can be written on with various types of writing instruments, the sheet is resistant to becoming electrically charged even in environments of low humidity, and the back side can be separated without adhering to the dye film even when printing is performed while mistaking the dye receptive side and back side.

BEST MODE FOR CARRYING OUT THE INVENTION

The following provides a detailed explanation of the present invention by showing desirable modes for carrying it out.

Substrate Sheet

Synthetic paper (polyolefin-based, polystyrene-based, etc.), cellulose fiber paper such as high-quality paper, art paper, coated paper, cast coated paper, wall paper, paper for back stamping, synthetic resin or emulsion impregnated paper, synthetic rubber latex impregnated paper, synthetic resin-containing paper and cardboard, as well as various types of plastic films or sheets such as those made of polyolefin, polystyrene, polycarbonate, polyethylene terephthalate, polyvinyl chloride and polymethacrylate can be used for the substrate sheet used in the present invention. In addition, white opaque films formed by adding white pigment or filler to these synthetic resins or films having microvoids within the base material can also be used, and there are no particular limitations. In addition, laminates consisting of an arbitrary combination of the above substrate sheets can also be used.

Typical examples of laminates include laminates consisting of cellulose fiber paper and synthetic paper, or cellulose fiber paper and plastic film or sheet. The thickness of these substrate sheets is arbitrary, and a thickness on the order of, for example, 10 to 300 μm is typical. As described above, in the case the substrate sheet lacks adhesiveness with the receptive layer formed on its surface, it is preferable that simple adhesive treatment be performed on its surface such as primer treatment, corona discharge treatment or plasma treatment.

In addition, the thermal transfer image receiving sheet of the present invention can be applied to various applications such as thermal transfer sheets that allow thermal transfer recording, cards and transmission-type manuscript production sheets by suitably selecting the substrate sheet.

Receptive Layer

The receptive layer is for receiving sublimating dye that migrates from the thermal transfer sheet and maintaining the formed image. Examples of resins for forming the receptive layer include polycarbonate resins, polyester resins, polyamide resins, acrylic resins, cellulose resins, polysulfone resins, polyvinyl chloride resins, polyvinylacetate resins, vinyl chloride-vinylacetate copolymer resins, polyvinylacetal resins, polyvinylbutyral resins, polyurethane resins, polystyrene resin, polypropylene resins, polyethylene resins, ethylene-vinyl acetate copolymer resins and epoxy resins.

The thermal transfer image receiving sheet of the present invention can contain a separating agent in the receptive layer for improving separation from the thermal transfer sheet. Although examples of separating agents include solid waxes such as polyethylene wax, amide wax and Teflon powder, fluorine or ester phosphate-based surface active agents, silicone oil, and various types of silicone resins, our of which silicone oil is preferable.

Although that in oil form can be used for the above silicone oil, a cured form thereof is preferable. Although examples of cured silicone oils include reaction-cured types, photocured types and catalyst-cured types, reaction-cured and catalyst-cured types of silicone oils are particularly preferable.

The products of reaction-curing of amino-denatured silicone oils and epoxy-denatured silicone oils are preferable for the reaction-cured silicone oil. Examples of amino-denatured silicone oils include KF-393, KF-857, KF-858, X-22-3680 and X-22-380 1C (all of the above are products of Shin- Etsu Chemical Co., Ltd., Japan), while examples of epoxy-denatured silicone oils include KF-100T, KF-101, KF-60-164 and KF-103 (all of the above are products of Shin-Etsu Chemical Co., Ltd.). Examples of catalyst-cured silicone oils include KS-705, FKS-770 and X-22-1212 (all of the above are products of Shin-Etsu Chemical Co., Ltd.).

The added amount of these cured silicone oils is preferably 0.5 to 30 wt % of the resin that composes the receptive layer.

In addition, a separating agent layer can also be provided on a portion of the surface of the receptive layer by dissolving or dispersing the above separating agent in a suitable solvent followed by coating and drying. The previously mentioned reaction-cured products of amino-denatured silicone oils and epoxy-denatured silicone oils are particularly preferable as separating agents that compose the separating agent layer, and the thickness of the separating agent layer is preferably 0.01 to 5.0 μm, and particularly preferably 0.05 to 2.0 μm. Furthermore, when the receptive layer is formed by adding silicone oil, the separating agent layer can also be formed by curing silicone oil that has been bled out onto the surface thereof after coating.

Furthermore, when forming the above receptive layer, pigments and fillers such as titanium oxide, zinc oxide, kaolin, clay, calcium carbonate and fine powdered silica can be added for the purpose of improving the whiteness of the receptive layer and further enhancing the clearness of the transfer images.

In addition, plasticizers such as phthalic ester compounds, sebacic ester compounds and phosphoric ester compounds may also be added.

The thermal transfer image receiving sheet of the present invention is obtained by forming a dye receptive layer on at least one side of the above substrate sheet by coating and drying a dispersion obtained by dissolving in a suitable organic solvent or dispersing in organic solvent or water a mixture containing a thermoplastic resin like that described above and other necessary additives such as separating agents, plasticizers, fillers, crosslinking agents, curing agents, catalysts, heat separating agents, ultraviolet absorbers, antioxidants and photostabilizers, by a forming means such as, for example, gravure printing, screen printing and reverse roll coating using a gravure plate.

Although the dye receptive layer formed in the manner described above may have any arbitrary thickness, it typically has a thickness of 1 to 50 μm when dried. In addition, although it is preferable that this type of dye receptive layer be a continuous coating, it may be formed in the form of a discontinuous coating using a resin emulsion or resin dispersion.

Intermediate Layer

Any types of intermediate layers known in the prior art can be provided between the receptive layer and substrate sheet for the purpose of giving properties such as adhesion between the receptive layer and substrate sheet, whiteness, cushioning, concealability, antistatic properties and curling prevention. Examples of binder resins used in the intermediate layer include polyurethane resins, polyester resins, polycarbonate resins, polyamide resins, acrylic resins, polystyrene resins, polysulfone resins, polyvinyl chloride resins, polyvinylacetate resins, vinyl chloride-vinyl acetate copolymer resins, polyvinylacetal resin, polyvinylbutyral resin, polyvinyl alcohol resin, epoxy resins, cellulose resins, ethylene-vinyl acetate copolymer resin, polyethylene resins and polypropylene resins, and isocyanate-cured products of those resins having active hydrogen can also be used as binder.

In addition, it is preferable to add fillers such as titanium oxide, zinc oxide, magnesium carbonate and calcium carbonate in order to give whiteness and concealability. Moreover, stilbene compounds, benzoimidazole compounds or benzooxazole compounds and so forth can be added as fluorescent whiteners to enhance whiteness, hindered amine compounds, hindered phenol compounds, benzotriazole compounds or benzophenone compounds and so forth can be added as ultraviolet absorbers or antioxidants to enhance the light fastness of the printed images, or cationic acrylic resins, polyaniline resins or various types of electric conductive fillers and so forth can be added to give antistatic properties.

Back Layer

As a result of earnest research for the purpose of providing a thermal transfer image receiving sheet comprising the constitution by forming a back layer that can be written on with various types of writing instruments on the side opposite the side on which a dye receptive layer is formed, which is resistant to becoming electrically charged even in environments of low humidity, and allows the back layer to be separated without adhering to a dye film even when printing is performed while mistaking the dye receptive layer side and back side, the above problems were successfully solved by forming a hydrophilic porous layer (back writing layer), having for its main components a thermoplastic resin such as butyral resin or acetal resin and hydrophilic porous particles such as untreated microsilica, on the opposite side of the side on which the dye receptive layer is formed, and additionally forming an electric conductive separation layer, having for its main components cationic acrylic resin and cellulose acetate, on top of the above layer.

An example of a technique for giving writing properties to a back layer is the prior art like that described in Japanese Patent Application Laid-Open No. HEI 9-175048. As is described in Japanese Patent Application Laid-Open No. HEI 9-193561, as an example of a technique for giving separation properties to a back layer, it is proposed that a separation layer using a polymer having low compatibility with the other polymer (such as polyvinyl alcohol or cellulose acetate) be provided on a hydrophilic porous layer having for its main components butyral resin or acetal resin and untreated microsilica. As an example of techniques for giving antistatic properties, namely electrical conductivity, it is typically known to use ion conducting antistatic agents such as compounds containing quaternary ammonium base (including polymers) or compounds containing sodium sulfonate groups (including polymers), metal oxide antistatic agents such as zinc oxide (ZnO) and stannic oxide ($SnO_2$), or electric conductive polymers.

There are generally two ways to give electrical conductivity, namely a method for giving electrical conductivity to the surface of a dye receptive layer, and a method for giving electrical conductivity to the back layer side. However, in consideration of the effects on the image and so forth, it is preferable to give electrical conductivity to the back side. In the case of giving writing properties to the back side as described above, there are three possible methods that can be considered, namely a method of providing an electric conductive layer between a hydrophilic porous layer, having for its main components butyral resin and microsilica, and a substrate sheet, a method of adding an electric conductive material directly to said hydrophilic porous layer, and a method of providing an electric conductive layer on said hydrophilic porous layer. However, in consideration of the electrical conductivity of the porous layer being low, methods involving the providing of an electric conductive layer between a hydrophilic porous layer and substrate sheet, or methods involving the addition of an electric conductive material directly to a hydrophilic porous layer are not very effective.

Thus, it is preferable to give electrical conductivity to a thermal transfer image receiving sheet by a method in which an electric conductive layer is provided on a hydrophilic porous layer. It was found that it is preferable to use a cationic acrylic resin containing quaternary ammonium base for the electric conductive layer, and that in order to give separation properties simultaneous to electrical conductivity while also giving moisture resistance, it is most effective to use cellulose acetate as a blend with cationic acrylic resin.

Although cationic acrylic resin and cellulose acetate are essentially incompatible resins, this property of being mutually incompatible plays an important role for allowing coexistence of the performance expressed by cationic acrylic resin (giving electrical conductivity and moisture absorption, namely the ability to be written on with a water-based pen and so forth) and the performance expressed by cellulose acetate (separation properties and moisture resistance). Namely, since an electric conductive separation layer composed of cationic acrylic resin and cellulose acetate is formed as a layer comprising microseparated phases of these resins, it becomes possible for the above performances to coexist.

Although it is more preferable to provide one electric conductive separation layer composed of cationic acrylic resin and cellulose acetate, nearly the same performance can be obtained even in the case of providing an electric conductive layer, having for its main component cationic acrylic resin, on a hydrophilic porous layer, and further providing a separation layer, having for its main component cellulose acetate, on top of said electric conductive layer.

More specifically, the cationic acrylic resin that is used preferably has the chemical formula shown below,

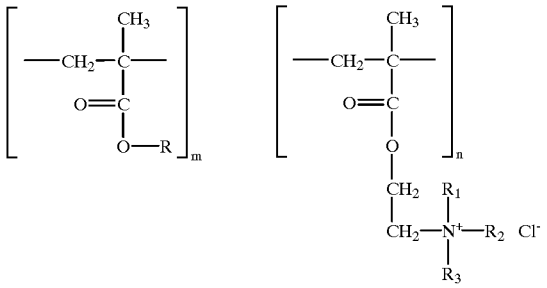

wherein R, $R_1$, $R_2$ and $R_3$ are alkyl groups having at least one carbon atom, and preferably 1 to 8 carbon atoms, such as a methyl group, ethyl group, propyl group and butyl group.

In addition, the cellulose acetate is preferably that having an acetic value of 40–65%, and average polymerization degree of 50–400.

By forming a hydrophilic porous layer having for its main components thermoplastic resin and hydrophilic porous particles on the opposite side of a substrate sheet on which a receptive layer is formed, and further forming an electric conductive separation layer having for its main components cationic acrylic resin and cellulose acetate on top of said hydrophilic porous layer, a back side having excellent antistatic properties is formed that can be written on with a pencil, water-based pen or ball point pen, etc., and can be separated from a dye film even in the case printing is mistakenly performed on the back side. Preferably, a resin having hydrophilic functional groups such as OH groups, etc. that is also simultaneously provided with adequate moisture resistance, examples of which include polyvinylbutyral and polyvinylacetal, is used for the binder resin of the hydrophilic porous layer, while hydrophilic untreated microsilica manufactured by a wet method is preferably used for the hydrophilic porous particles.

Hydrophilic Porous Layer

Although various types of thermoplastic resins can be used for the binder thermoplastic resin, it is necessary that said thermoplastic resin function as a binder as well as have dye soiling resistance so that the back of the image receiving sheet is not soiled by dye and so forth as previously described. Thermoplastic resins having low dyeing properties are preferable, while polyvinylbutyral is particularly preferable. In addition, it is even more preferable that the polyvinylbutyral be cured by adding chelating agent, isocyanate compound and so forth.

Butyral resins or acetal resins having a high polymerization degree are preferable with respect to having high coating strength and being able to add a greater number of hydrophilic porous particles such as untreated microsilica, with those having a polymerization degree of at least 500 being particularly preferable. In consideration of coating aptitude, it is necessary that the resin have a suitable viscosity when formed into an ink, and for this reason, it is better if the polymerization degree not be excessively high, with that having a polymerization degree of 3000 or less being preferable.

In addition, it is preferable to use hydrophilic porous microsilica manufactured using a wet method that has a pore volume of 0.2–3.0 ml/g. Although only one type of microsilica may be used, the use of a combination of at least one type each of microsilica having a pore volume of 0.2–0.9 ml/g and microsilica having a pore volume of 1.2–3.0 ml/g is more preferable with respect to being able to effectively take advantage of the characteristics of each. Namely, since hydrophilic porous microsilica having a low pore volume within the range of 0.2–0.9 ml/g has adequate hardness for being written on with a pencil, and has better hydrophilic and moisture absorption properties than ordinary hydrophilic fillers, it contributes to writing ability with a water-based writing instrument as well as improvement of stamp adhesive property. In addition, since hydrophilic porous microsilica having a large pore volume within the range of 1.2–3.0 ml/g has somewhat lower hardness, although it is somewhat inadequate for being written on with a pencil, due to its excellent hydrophilic and moisture absorption properties, it is particularly effective for improving writing ability with a water-based writing instrument and stamp adhesive property.

In addition, although microsilica can also be manufactured using a dry method, in the case of using a dry method, since silicon tetrachloride is produced as a result of combustion in the vapor phase and hydrolysis, there are no voids within the microsilica particles formed. Namely, silica is formed that does not have any internal surface area. This type of silica has a low level of moisture absorption, and is not suited for applications requiring hydrophilic and moisture absorption properties as in the present invention. Conversely, since microsilica manufactured using a wet method (gel method) is produced by gelatinizing microsilica formed by reaction between aqueous sodium silicate and sulfuric acid or hydrochloric acid, porous silica is obtained. In addition to being porous, since this type of silica has hydrophilic functional groups (silanol groups) on its surface, it has higher hydrophilic and moisture absorption properties and is optimal for improving writing ability with a water-soluble pen and stamp adhesive property in comparison with ordinary hydrophilic fillers. Furthermore, there are some cases in which it is not preferable for silica manufactured using a wet method to be hydrophilic depending on the application of the silica, and there is some silica of which the surface has been treated by organic or inorganic substances to reduce hydrophilic properties. In the present invention, however, it is important that the silica be hydrophilic, and the use of untreated silica is preferable.

Pore volume is used as a parameter for indicating the porosity of microsilica. Normally, since surface area increases as pore volume increases along with an increase in the number of silanol groups per unit volume, hydrophilic and moisture absorption properties are improved, and fixation of water-based ink such as that of a fountain pen or water-based pen and stamp adhesive property are improved. Although this is preferable for the above reasons, if pore volume exceeds 3.0 ml/g, hydrophilic properties conversely become excessively high causing water-based ink to run, and due to the voids in the microsilica particles becoming larger, hardness decreases resulting in problems including decreased writing ability with a pencil, thus making this undesirable. On the other hand, in the case pore volume is less than 0.2 ml/g, although hardness is adequate and writing ability with a pencil is good, fixation of water-based ink and stamp adhesive property are decreased due to decreases in hydrophilic and moisture absorption properties, thus making this undesirable.

Microsilica like that described above can be used within a particle diameter range of 0.5–15 $\mu$m, and more preferably 1–5 $\mu$m, in terms of mean particle diameter. If the mean particle diameter is less than 0.5 $\mu$m, pencil writing properties are inadequate. In addition, if mean particle diameter exceeds 15 $\mu$m, there is greater susceptibility to running when using a water-based writing instrument, and the surface coefficient of friction increases resulting in decreased transport properties, thus making this undesirable.

The amount of microsilica added relative to thermoplastic resin is preferably within the range of 0.1–3.0 as the weight ratio of microsilica to thermoplastic resin. If the above weight ratio is less than 0.1, adequate writing aptitude and stamp adhesive property are unable to be obtained. In addition, if the weight ratio exceeds 3.0, in addition to coating aptitude decreasing, coating strength also decreases resulting in problems such as greater susceptibility to peeling of the coating when written on with a writing instrument, thus making this undesirable.

Furthermore, it is also important to improve the transport property of the image receiving sheet, such as the ease of paper feeding and discharge in a printer. In order to accomplish this, containing a spherical lubricating filler having a particle diameter larger than that of microsilica in the hydrophilic porous layer of the above composition to lower the friction coefficient of the surface is effective in preventing multiple sheets from being fed through the printer at one time and so forth. The mean particle diameter of the spherical lubricating filler is preferably 5–15 $\mu$m, and it is preferably made of spherical Nylon filler.

In order for the above hydrophilic porous layer to adequately demonstrate its performance, it is preferable that the coated amount thereof be 0.5–10.0 g/m$^2$ as solid. In the case the coated amount is less than 0.5 g/m$^2$, since there is insufficient amount of microsilica, adequate writing ability and stamp adhesive property are unable to be obtained. In addition, in the case the coated amount exceeds 10.0 g/m$^2$, material and processing costs increase, thus making this undesirable.

Although the above hydrophilic porous layer may be provided directly on a substrate sheet, in the case the adhesion of the hydrophilic porous layer to the substrate sheet is insufficient, an intermediate layer having for its main component a resin that has good adhesion for both the substrate sheet and hydrophilic porous layer may be provided between both, and whiteners such as titanium oxide, calcium carbonate and fluorescent whitener, or other additives such as pigment can be added to the intermediate layer. In addition, a known intermediate layer used between the above substrate sheet and coloring material receiving layer can be similarly used as is between the substrate sheet and hydrophilic porous layer.

Electric Conductive Separation Layer

In the present invention, even if the thermal transfer image receiving sheet is passed through a printer while mistakenly turning upside-down, an electric conductive separation/releasing layer is laminated over the above hydrophilic porous layer so that the image receiving sheet is discharged smoothly without the back of the image receiving sheet melting and adhering to the surface of the ink layer of the thermal transfer sheet, while also resisting becoming electrically charged even in environments of low humidity.

Thus, it is necessary that the electric conductive separation layer not melt and become adhered to the ink layer of the thermal transfer sheet, not be dyed by dye, and not lose the postcard aptitude of the above hydrophilic porous layer in terms of its writing aptitude, stamp adhesive property and so forth. Moreover, it must be electric conductive so that it resists becoming electrically charged even in environments of low humidity.

In the thermal transfer image receiving sheet of the present invention, by forming an electric conductive separation layer having for its main components cationic acrylic resin and cellulose acetate, even though cationic acrylic resin and cellulose acetate are essentially incompatible resins, this property of being mutually incompatible makes it possible to allow the coexistence of the performance of giving electrical conductivity and moisture absorption by cationic acrylic resin, and the performance of giving separation properties and moisture resistance by cellulose acetate to coexist.

Namely, since an electric conductive separation layer composed of cationic acrylic resin and cellulose acetate is formed as a layer in which the phases of these resins are separated, the above performances are able to coexist.

It is preferable to use acrylic resins containing quaternary ammonium base as groups that give electrical conductivity for the cationic acrylic resin. The blending ratio of cationic acrylic resin to cellulose acetate is preferably from 1:5 to 5:1. If the blended amount of cationic acrylic resin is too low, adequate antistatic effects cannot be obtained. If the blended amount of cellulose acetate is too low, adequate separation from the dye film and moisture resistance cannot be obtained.

As described above, although it is more preferable to provide one layer of an electric conductive separation layer composed of cationic acrylic resin and cellulose acetate, nearly the same performance is obtained in the case of using a composition wherein an electric conductive layer having for its main component cationic acrylic resin is provided on a hydrophilic porous layer, and a separation layer having for its main component cellulose acetate is further provided on said electric conductive layer.

It is preferable that the electric conductive separation layer be laminated to a thin film thickness of 0.01–1.0 $\mu$m when dried. In the case the film thickness is less than 0.01 $\mu$m, adequate separation and antistatic effects are unable to be obtained. In the case the film thickness exceeds 1.0 $\mu$m, adequate writing aptitude and stamp adhesive property are unable to be obtained, thus making this undesirable.

An antistatic layer containing a conventionally known antistatic agent may also be provided on the receptive layer and electric conductive separation layer in order to improve antistatic properties.

The thermal transfer sheet used when performing thermal transfer using the thermal transfer image receiving sheet of the present invention as described above has a dye layer containing sublimating dye provided on paper or polyester film, and all conventionally known thermal transfer sheets can be used in the present invention without modification.

In addition, conventionally known means for providing heat energy can be used for providing heat energy during thermal hi transfer. The expected object can be adequately achieved by providing heat energy on the order of 5–100 mJ/mm$^2$ through control of recording time by using a recording device such as a thermal printer (e.g., Video Printer VY-100 manufactured by Hitachi, Ltd.).

The following provides a more detailed explanation of the present invention through its examples. All parts and percentages used herein are expressed as weight basis unless otherwise specified.

EXAMPLE 1

Using synthetic paper (YUPO FPG-150, thickness: 150 $\mu$m, manufactured by Oji Petrochemical Synthetic Paper K.K., Japan) for the substrate sheet, white intermediate layer coating solution and dye receptive layer coating solution having the compositions shown below were sequentially coated and dried onto one side of the sheet in the coated amounts of 2.0 g/m$^2$ (solid portion) and 5.0 g/m$^2$ (solid portion), respectively, by roll coating method.

| White Intermediate Layer Coating Solution | |
|---|---|
| Polyurethane resin (Nipporane 5199, manufactured by Nippon Polyurethane Kogyo K.K., Japan) | 25 parts |
| Titanium oxide (TCA-888, manufactured by Tochem Products K.K., Japan) | 75 parts |
| Toluene | 200 parts |
| Methylethyl ketone | 200 parts |
| **Dye Receptive Layer Coating Solution** | |
| Vinylchloride-vinylacetate copolymer (#1000A, manufactured by Denki Kagaku Kogyo K.K., Japan) | 100 parts |
| Epoxy denatured silicone (X-22-3000T, manufactured by Shin-Etsu Chemical) | 5 parts |
| Toluene | 200 parts |
| Methylethyl ketone | 200 parts |

Moreover, hydrophilic porous layer coating solution and electric conductive separation layer coating solution 1 having the compositions indicated below were sequentially coated and dried on the other side of the above substrate sheet in the coated amounts of 2.0 g/m$^2$ (solid portion) and 0.4 g/m$^2$ (solid portion), respectively, by roll coating method to prepare the thermal transfer image receiving sheet of Example 1.

| Hydrophilic Porous Layer Coating Solution | |
|---|---|
| Polyvinylbutyral resin (#5000A, manufactured by Denki Kagaku Kogyo) | 30 parts |
| Microsilica (Silicia 310, manufactured by Fuji Silicia Kagaku K.K., Japan) | 45 parts |
| Microsilica (Silicia 730, manufactured by Fuji Silicia Kagaku K.K., Japan) | 20 parts |
| Chelating agent (Orgatix TC-750, manufactured by Matsumoto Pharmaceutical K.K., Japan) | 5 parts |
| Toluene | 300 parts |
| Isopropyl alcohol | 100 parts |
| **Electric Conductive Separation Layer Coating Solution 1** | |
| Cellulose acetate (L-20, manufactured by Daicel Chemical Industries K.K., Japan) | 2 parts |
| Cationic acrylic resin (Elecond PQ-50B, manufactured by Shuken Chemical) | 3 parts |
| Methylethyl ketone | 80 parts |
| Methyl alcohol | 15 parts |

EXAMPLE 2

With the exception of using electric conductive separation layer coating solution 2 having the composition indicated below instead of using electric conductive separation coating layer 1 used in Example 1, the thermal transfer image receiving sheet of Example 2 was prepared in the same manner as Example 1.

| Electric Conductive Separation Layer Coating Solution 2 | |
|---|---|
| Cellulose acetate (L-20, manufactured by Daicel Chemical Industries) | 1 part |
| Cationic acrylic resin (Elecond PQ-50B, manufactured by Shuken Chemical K.K., Japan) | 4 parts |
| Methylethyl ketone | 80 parts |
| Methyl alcohol | 15 parts |

EXAMPLE 3

With the exception of using electric conductive separation layer coating solution 3 having the composition indicated below instead of electric conductive separation layer coating solution 1 used in Example 1, the thermal transfer image receiving sheet of Example 3 was prepared in the same manner as Example 1.

| Electric Conductive Separation Layer Coating Solution 3 | |
|---|---|
| Cellulose acetate (L-40, manufactured by Daicel Chemical Industries) | 2 parts |
| Cationic acrylic resin (Elecond PQ-50B, manufactured By Shuken Chemical K.K., Japan) | 3 parts |
| Methylethyl ketone | 80 parts |
| Methyl alcohol | 15 parts |

EXAMPLE 4

With the exception of using electric conductive separation layer coating solution 4 having the composition indicated below instead of electric conductive separation layer coating solution 1 used in Example 1, the thermal transfer image receiving sheet of Example 4 was prepared in the same manner as Example 1.

| Electric Conductive Separation Layer Coating Solution 4 | |
|---|---|
| Cellulose acetate (L-20, manufactured by Daicel Chemical Industries) | 3 parts |
| Cationic acrylic resin (Elecond PQ-10, manufactured By Shuken Chemical K.K., Japan) | 2 parts |
| Methylethyl ketone | 80 parts |
| Methyl alcohol | 15 parts |

EXAMPLE 5

Using an electric conductive coating solution and separation layer coating solution having the compositions shown below instead of the electric conductive separation layer coating solution 1 used in Example 1, a hydrophilic porous layer, electric conductive layer and separation layer were sequentially formed on one side of a substrate sheet. However, the coating solutions were coated and dried by roll coating method so that the coated amount of the electric conductive layer was 0.3 g/m$^2$ (solid portion) and the coated amount of the separation layer was 0.1 g/m$^2$ (solid portion). The thermal transfer image receiving sheet of Example 5 was then prepared in the same manner as Example 1 with respect to the other steps.

| Electric Conductive Layer Coating Solution | |
|---|---|
| Cationic acrylic resin (Elecond PQ-50B, manufactured by Shuken Chemical K.K., Japan) | 2 parts |
| Methylethyl ketone | 85 parts |
| Methyl alcohol | 12 parts |
| Separation Layer Coating Solution | |
| Cellulose acetate (L-20, manufactured by Daicel Chemical Industries) | 3 parts |
| Methylethyl ketone | 97 parts |

COMPARATIVE EXAMPLE 1

With the exception of using electric conductive separation layer coating solution 5 having the composition indicated below instead of electric conductive separation layer coating solution 1 used in Example 1, the thermal transfer image receiving sheet of Comparative Example 1 was prepared in the same manner as Example 1.

| Electric Conductive Separation Layer Coating Solution 5 | |
|---|---|
| Polyvinyl alcohol resin (KM-11, manufactured by Nippon Synthetic Chemical Industry) | 5 parts |
| Water | 65 parts |
| Isopropyl alcohol | 30 parts |

COMPARATIVE EXAMPLE 2

With the exception of using electric conductive separation layer coating solution 6 having the composition indicated below instead of electric conductive separation layer coating solution 1 used in Example 1, the thermal transfer image receiving sheet of Comparative Example 2 was prepared in the same manner as Example 1.

| Electric Conductive Separation Layer Coating Solution 6 | |
|---|---|
| Cellulose acetate (L-20, manufactured by Daicel Chemical Industries) | 5 parts |
| Methylethyl ketone | 80 parts |
| Methyl alcohol | 15 parts |

Writing Properties

Characters were written on the backs of the thermal transfer image receiving sheets of the above examples and comparative examples using the writing instruments indicated below followed by evaluation of writing properties based on the following standards.

(Writing Instruments)

a) Pencil: Mitsubishi Clerical Pencil No. 9800 HB (manufactured by Mitsubishi Pencil)

b) Water-based pen: Pentel Sign Pen Black (manufactured by Pentel)

c) Oil-based pen: Magic Ink No. 700 Black (manufactured by Teranishi Chemical Industries)

d) Ball point pen: Jimny Black (manufactured by Zebra)

(Evaluation Standards)

○: Able to write smoothly with adequate density, no running, good fixation

Δ: Characters somewhat light or slight running

X: Characters no longer legible when rubbed gently with the fingers

Separation Properties of Back of Image Receiving Sheet

Using a PK700L thermal transfer sheet for the CP-700 video printer manufactured by Mitsubishi Electric Co., the backs of the image receiving sheets of each of the above examples and comparative examples were superimposed in opposition to the respective dye layers, and thermal transfer recording was performed using a thermal head under the conditions indicated below from the back of the thermal transfer sheet for each of the colors of yellow, magenta and cyan to evaluate separation properties, namely the degree of melting and adhesion of the back of the thermal transfer image receiving sheet to the thermal transfer sheet.

(Printing Conditions)

Thermal head: KGT-2 17–12MPL20 (manufactured by Kyocera)

Heating element mean resistance value: 3195 (Ω)

Main scanning direction printing density: 300 dpi

Auxiliary scanning direction printing density: 300 dpi

Applied electrical power: 0.12 (W /dot)

Single line cycle: 5 (msec.)

Printing starting temperature: 40 (° C.)

Gradation Control Method:

Using a multi-pulse test printer able to vary the number of pulse divisions having a pulse length resulting from equally dividing a single line cycle into 256 equal divisions from 0 to 256 divisions, the duty ratio of each pulse division was fixed at 60% and solid printing was performed with the three colors of yellow, magenta and cyan using 200 pulses.

The evaluation standards were as indicated below.

○: No melting or adhesion and easy separation.

Δ: Hardly any melting or adhesion, but difficulty in separation or partial melting or adhesion.

X: Melting and adhesion.

Antistatic Properties

Using the Static Honestmeter H-0110 manufactured by Shishido Electrostatic, antistatic properties, namely the ease with which a given electrical charge is attenuated, were evaluated according to the standards indicated below.

(Evaluation Method)

Using samples measuring 40 mm×40 mm, the samples are given an electrical charge of +10 kV (or −10 kV) by corona discharge. The samples are moved away from the power source after waiting until the charge distribution state reaches a steady state. Since the electrical potential $E_0$ of the sample at this time decreases due to leakage current after the sample is moved away from the power source, measuring this rate of electrical potential decrease makes it possible to compare the antistatic properties of the samples.

Therefore, antistatic properties of the sample were compared by measuring the amount of time until electrical potential $E_0$ reaches $E_0/2$, namely half-life.

(Evaluation Standards)

○: Half life is less than 60 seconds.

X: Half life is 60 seconds or more.

Evaluation results are shown in Table 1.

TABLE 1

| | Writing Properties | | | | Separation of Image | Anti- |
|---|---|---|---|---|---|---|
| | Pencil | Water-based pen | Oil-based pen | Ball point pen | Receiving Sheet | static properties |
| Ex. 1 | ○ | ○ | ○ | ○ | ○ | ○ |
| Ex. 2 | ○ | ○ | ○ | ○ | ○ | ○ |

TABLE 1-continued

| | Writing Properties | | | | Separation of Image | Anti- |
|---|---|---|---|---|---|---|
| | Pencil | Water-based pen | Oil-based pen | Ball point pen | Receiving Sheet | static properties |
| Ex. 3 | ○ | ○ | ○ | ○ | ○ | ○ |
| Ex. 4 | ○ | ○ | ○ | ○ | ○ | ○ |
| Ex. 5 | ○ | ○ | ○ | ○ | ○ | ○ |
| Comp. Ex. 1 | ○ | ○ | ○ | ○ | Δ | X |
| Comp. Ex. 2 | ○ | X | ○ | ○ | ○ | X |

As has been described above, the heat transfer image receiving sheet of the present invention is that comprising a substrate sheet and a dye receptive layer on at least one side of the substrate sheet, wherein a hydrophilic porous layer having for its main components thermoplastic resin and hydrophilic porous particles is formed on the side opposite the side on which the dye receptive layer is formed, and an electric conductive releasing layer having for its main components cationic acrylic resin and cellulose acetate is formed on the above layer. Consequently, the hydrophilic porous layer in particular gives writing properties to the back layer. Moreover, since the cationic acrylic resin and cellulose acetate of the electric conductive releasing layer are essentially incompatible resins, this property of being mutually incompatible gives electrical conductivity and water absorption due to the cationic acrylic resin, and gives separating and water-resistant performance due to the cellulose acetate. Consequently, the back layer can be written on with various types of writing instruments, the sheet is resistant to becoming electrically charged even in environments of low humidity, and the back side can be separated without adhering to the dye film even when printing is performed while mistaking the dye receptive side and back side.

What is claimed is:

1. A thermal transfer image receiving sheet comprising a substrate sheet and a dye receptive layer formed on at least one side of said substrate sheet, wherein a hydrophilic porous layer comprising a thermoplastic resin and hydrophilic porous particles of untreated microsilica having a pore volume of from 0.2 to 3.0 ml/g and a mean particle diameter of from 0.2 to 5.0 μm, and an electric conductive releasing layer comprising cationic acrylic resin and cellulose acetate, are formed in this order on the side of the substrate sheet on which said dye receptive layer is not formed.

2. A thermal transfer image receiving sheet as set forth in claim 1, wherein the thermoplastic resin that composes the hydrophilic porous layer is one selected from the group consisting of butyral resin, acetal resin and a mixture thereof.

3. A thermal transfer image receiving sheet comprising a substrate sheet and a dye receptive layer formed on at least one side of said substrate sheet, wherein a hydrophilic porous layer comprising a thermoplastic resin and hydrophilic porous particles of untreated microsilica having a pore volume of from 0.2 to 3.0 ml/g and a mean particle diameter of from 0.2 to 5.0 μm, an electric conductive layer comprising cationic acrylic resin, and a releasing layer comprising cellulose acetate are formed in this order on the side of the substrate sheet on which said dye receptive layer is not formed.

4. A thermal transfer image receiving sheet as set forth in claim 3, wherein the thermoplastic resin that composes the hydrophilic porous layer is one selected from the group consisting of butyral resin, acetal resin and a mixture thereof.

* * * * *